US005743276A

United States Patent [19]

Tamayo-Rivera et al.

[11] Patent Number: 5,743,276

[45] Date of Patent: Apr. 28, 1998

[54] CIGAR CADDIE DIVOT REPAIR TOOL

[75] Inventors: Stephanie A. Tamayo-Rivera, 1085 Dearborn La., Vernon Hills, Ill. 60061; Ken A. Arnswald, Mundelein, Ill.

[73] Assignee: Stephanie A. Tamayo-Rivera, Vernon Hills, Ill.

[21] Appl. No.: 760,307

[22] Filed: Dec. 4, 1996

[51] Int. Cl.[6] ..... A24F 13/00

[52] U.S. Cl. ..... 131/329; 131/259

[58] Field of Search ..... 473/282, 286; 131/329, 259, 260; 248/156, 530

[56] References Cited

U.S. PATENT DOCUMENTS

| | | | |
|---|---|---|---|
| D. 300,160 | 3/1989 | Johnson | 473/282 |
| 3,774,913 | 11/1973 | Dien | 273/162 D |
| 4,063,731 | 12/1977 | Kitay | 473/282 |
| 4,627,621 | 12/1986 | Tate | 473/282 |
| 4,960,278 | 10/1990 | Hainey | 473/282 |
| 5,054,777 | 10/1991 | Borden et al. | 473/282 |
| 5,121,519 | 6/1992 | Haugom | 473/282 |
| 5,152,524 | 10/1992 | Brown | 273/32 B |
| 5,224,700 | 7/1993 | Rosen | 473/282 |
| 5,292,120 | 3/1994 | Pehoski et al. | 473/282 |
| 5,393,052 | 2/1995 | Kennedy | 473/282 |
| 5,401,019 | 3/1995 | Wissman et al. | 473/282 |
| 5,409,212 | 4/1995 | Arnett | 473/282 |

*Primary Examiner*—Vincent Millin
*Assistant Examiner*—Charles W. Anderson
*Attorney, Agent, or Firm*—James P. Hanrath

[57] ABSTRACT

A cigar caddie divot repair tool comprises a ball mark repairer for repairing dents and divots in a golf green which is hingedly interconnected to a tray body to selectively and releaseably achieve a closed position wherein the ball mark repairer is substantially parallel to the tray body or an open position wherein said ball mark repairer is substantially perpendicular to the tray body. The tray body can support of a cigar, cigarette, or other object placed thereon and may serve as a grip concavity suited to receive a user's thumb when the ball mark repairer is being used to repair turf.

15 Claims, 2 Drawing Sheets

FIG. 1
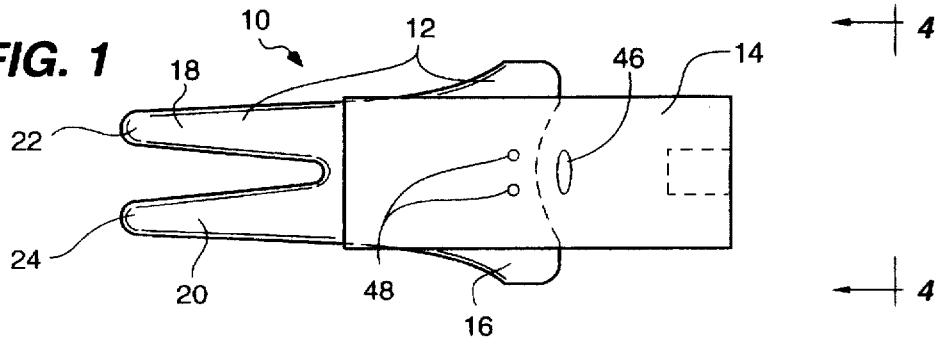
FIG. 2
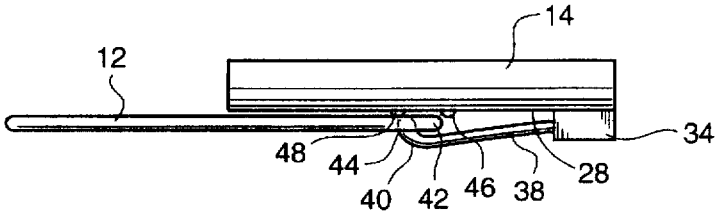
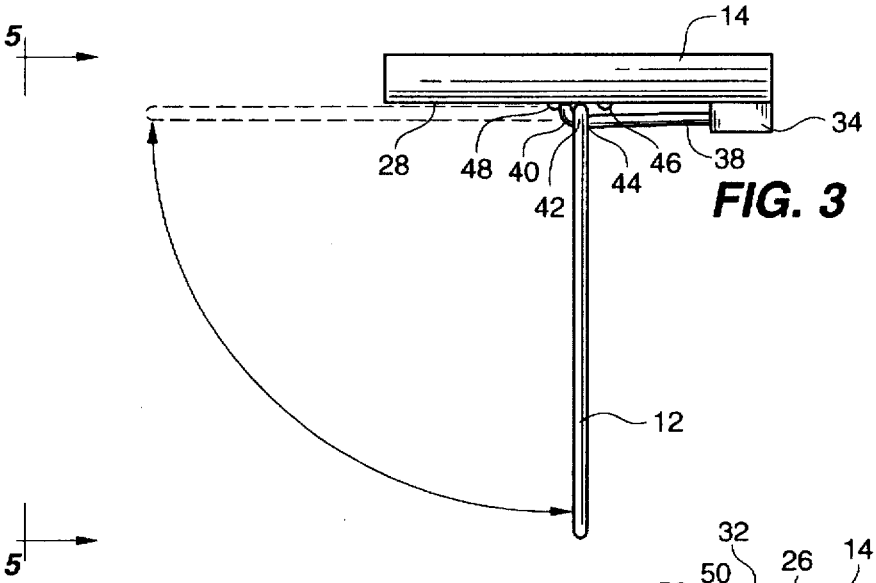
FIG. 3
FIG. 4
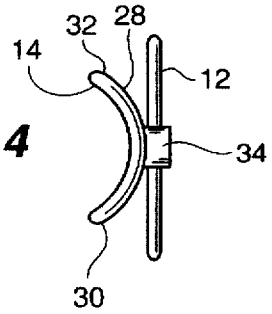
FIG. 5
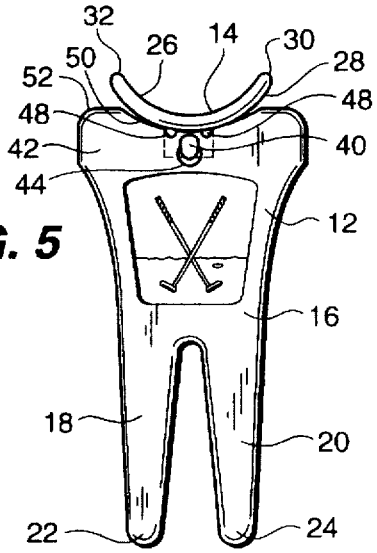

FIG. 6
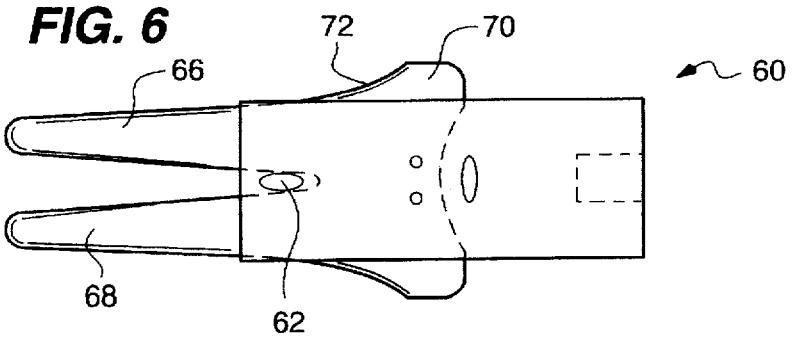
FIG. 7
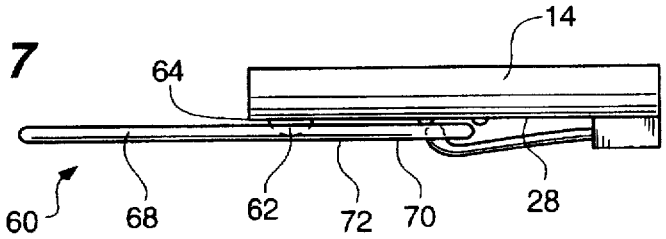
FIG. 8
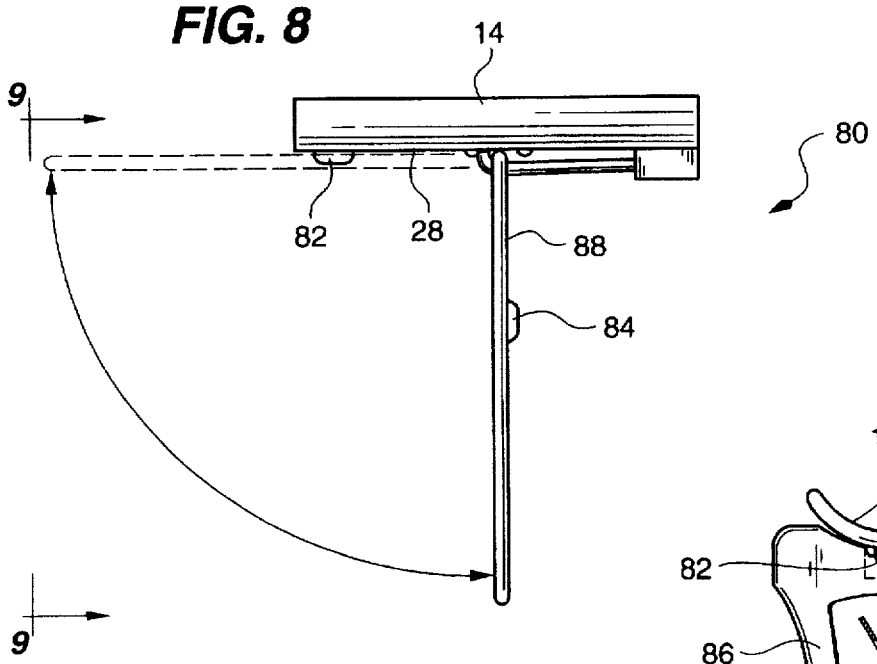
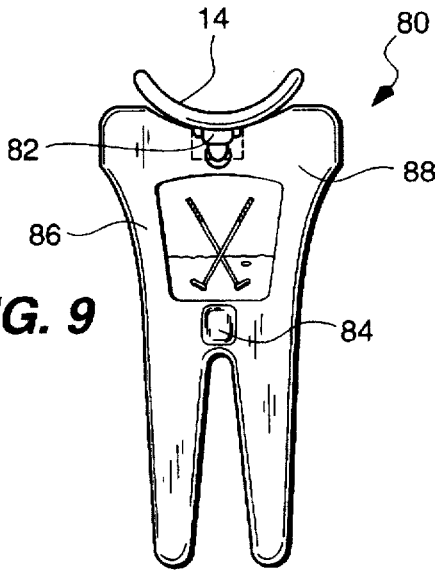
FIG. 9

CIGAR CADDIE DIVOT REPAIR TOOL

BACKGROUND OF THE INVENTION

1. Field of the Invention

This invention relates generally to tools and accessories used in the game of golf, and more specifically, to a tool for the repair of depressions in the surface of a golf green in combination with a tray body to hold a cigar or cigarette.

2. Description of the related art including information disclosed under 37 CFR §§ 1.97–1.99.

As is well known, the game of golf involves the striking of a golf ball in order to cause it to travel towards a hole on a golf green. At distances far removed from the hole, the golf ball is generally struck relatively forcefully, and will generally travel in an arcuate path through the air before hitting the ground at the end of its flight. The particular spot where the golf ball hits the earth may be damaged or depressed to a certain extent due to the impact of the ball. This is particularly true of golf greens, where the surface is exceptionally smooth and well manicured in order to provide the greatest accuracy for putting the golf ball on the final approach to the hole.

When a golfer approaches a golf green, it is a fundamental part of golf etiquette to repair the "ball mark" made upon the green by the impact of his golf ball. The resulting "ball mark" is typically a small depression corresponding to the shape of the ball or, in some cases, a shallow divot. The mark's size depends on a variety of factors, including the loft of the golf shot, the velocity of the ball on impact, the angle of the ball's flight on impact, and the amount of moisture in the green.

The "ball mark" thus creates a disturbance in the normally smooth surface of the green and produces a difficult and unpredictable obstacle for putting by future golfers. In addition, if the ball mark is not repaired, the grass within the depression will likely die and leave an unsightly brown spot, or divot, in the green. In order to be courteous to future golfers and in order to prevent unsightly brown spots in the greens which can affect the "putting line" for putts of future golfers, most golf courses require and continually remind golfers to repair their ball marks.

The prior art discloses a large number of devices for repairing divots or ball marks, and many such devices have secondary or other functions.

For example, U.S. Pat. No. 5,409,212 issued to Arnett discloses the combination of a tool for the repair of ball marks with a golf green slope indicator.

U.S. Pat. No. 5,224,700 issued to Rosen discloses a ball mark repair tool combined with a stop watch.

In U.S. Pat. No. 5,121,519 issued to Haugom, there is disclosed a ball mark repair tool in combination with a golf club groove cleaner.

In U.S. Pat. No. 5,054,777 issued to Borden et al., there is disclosed a golf accessory which includes a ball mark repair tool that has a brush mounted on its head with a slidable cover therefor.

In U.S. Pat. No. 4,960,278 issued to Hainey, there is disclosed a ball mark repair tool combined with a distance measuring device.

In U.S. Pat. No. 4,627,621 issued to Tate, there is disclosed a ball mark repair tool having a clip for attachment to the belt, cap, shoe, or golf bag of a golfer while alternatively used as a money clip. The golf mark repair tool includes a spherical segment having a radius equal to the radius of a golf ball such that the same can be used to check golf balls to determine departures from an ideal perfect symmetrical configuration. The repair tool also has a saddle portion which can be used to support the grip of a golf club to prevent the same from being laid in dew or wet portions of grass.

As the game of golf often takes several hours to play, many golfers enjoy smoking during the game. Smoking golfers will usually lay a lighted cigarette or cigar on the ground of a golf course while attending to the hitting of a golf ball with a club. While this may involve a danger of igniting the grass, a greater danger is subjecting the golfer to dangerous residue of herbicides, pesticides, and fertilizers which are used on all parts of the golf course, particularly tees and greens. Still other conditions of uncleanliness may result from the ground being stampled on by a large number of persons. Frequently, the cigar or cigarette will be left in place on the ground while the golfer's attention is directed to the flight of the struck golf ball and his upcoming next shot. It would be advantageous to smoking golfers to have a golf divot or "ball mark" repair tool that serves as a cigar caddie to rest a lighted cigarette or cigar in a tray body safely above safe the golf course grounds at a defined locus.

Examples of golf mark repair tools which have been used to support a cigarette or the grip end of a golf club to dispose the same above the grounds of a golf course include U.S. Pat. No. 5,401,019 issued to Wissman et al. which shows a multi-purpose golf tool which can repair golf marks and has a slot portion which may be used to hold a cigarette when the tool is in the upright position.

In U.S. Pat. No. 5,393,052 issued to Kennedy there is disclosed a ball mark repair device which may hold the grip end of a golf club above the dew or wet portions of golf course grounds.

In U.S. Pat. No. 4,063,731 issued to Kitay there is disclosed a multi-purpose golfer's tool which includes a ball mark repair tool, a tee-height gauge which may also serve as a cigarette holder, and a club support to support the grip of a golf club above the golf course grounds.

In U.S. Design Pat. No. Des. 300,160 to Johnson there is disclosed an ornamental design for a "ball mark" repairer which also serves as a shoehorn, cleat tightener and cleaner, and golf club and cigarette rest.

SUMMARY OF THE INVENTION

In accordance with the present invention, there is provided a cigar caddie divot repair tool comprising a ball mark repairer for repairing dents and divots in a golf green and a tray body attached to the ball mark repairer for the support of an object to be placed thereon. The ball mark repairer is preferably hingedly interconnected to the tray body to selectively achieve a closed position wherein the ball mark repairer is substantially parallel to the tray body or an open position wherein said ball mark repairer is substantially perpendicular to the tray body.

The cigar caddie divot repair tool of the present invention advantageously combines in a ball mark or divot repair tool a tray body to support a cigar or cigarette above the grounds of a golf course which may contain numerous types of herbicides, pesticides, and fertilizers. By providing a tray body for the support of a lighted cigarette or cigar, the golfer may attend to the striking or putting of a golf ball while leaving his or her cigarette or cigar placed upon the cigar caddie divot repair tool of the present invention in plain sight at a defined location safely separated from golf course chemicals or hazardous condition.

Additional features and advantages of the present invention will become apparent to those skilled in the art from the following description in the accompanying Figures illustrating the preferred embodiments of the invention, the same being the present best mode for carrying out the invention.

BRIEF DESCRIPTION OF THE DRAWINGS

FIG. 1 is a top view of a cigar caddie divot repair tool of the present invention in a closed position.

FIG. 2 is a side view of the cigar caddie divot repair tool illustrated in FIG. 1.

FIG. 3 is a side view of the cigar caddie divot repair tool illustrated in FIG. 2 but now showing the same in an upright open position.

FIG. 4 is a end view of the cigar caddie divot repair tool taken along line 4—4 of FIG. 1.

FIG. 5 is a front view of the cigar caddie divot repair tool in the upright open position taken along line 5—5 of FIG. 3.

FIG. 6 is a top view of another embodiment of the cigar caddie divot repair tool of the present invention in a closed position wherein a prong cooperative retention element at the underside of the tray body seats between the plurality of prongs of the ball mark repairer.

FIG. 7 is a side view of the cigar caddie divot repair tool illustrated in FIG. 6.

FIG. 8 is a side view of yet another embodiment of the cigar caddie divot repair tool of the present invention in an upright open position and shows a male retention element at the underside of the tray body which can seat within a female area of the base section of the ball mark repairer.

FIG. 9 is a front view of the cigar caddie divot repair tool illustrated in FIG. 8 taken along line 9—9 of FIG. 8.

DESCRIPTION OF THE PREFERRED EMBODIMENTS

Referring now to the drawings, there is shown in FIG. 1 a top view of a cigar caddie divot repair tool 10 according to the present invention. The cigar caddie divot repair tool 10 comprises a ball mark repairer 12 for repairing dents and divots in a golf green and a tray body 14 attached to the ball mark repairer 12 for the support of an object to be placed thereon. The ball mark repairer 12 is illustrated as a traditional ball mark repairer having a base section 16 and a plurality of prongs 18 and 20 extending downwardly from base section 16. Prongs 18 and 20 at their respective outer most ends 22 and 24 are sufficiently spaced from base section 16 to cooperate therewith to form a tool that is useful to repair turf.

As observed in the end view of FIG. 4 taken along line 4—4 of FIG. 1, tray body 14 has an upper surface 26, an underside surface 28, a left side portion 30, and a right side portion 32. The tray body 14 further includes a base 34 at underside surface 28. Left side portion 30 and right side portion 32 are each upwardly curved at their side contours to provide a concave form to the tray body 14 suited to receive and support a cigar or a cigarette of a user placed on the upper surface 26 thereof. The tray body 14 may also support another object such as the grip portion of a golf club to support the same above ground level as when necessary for a golfer to maintain a dry club grip by keeping the club from laying in dew or moist grass.

Referring now to FIG. 2, there is shown a side view of the cigar caddie divot repair tool 10 illustrated at FIGS. 1. in a closed position wherein ball mark repairer 12 is substantially parallel to tray body 14. The underside surface 28 of tray body 14 includes base 34 which retains one end portion of a spring rod 38. Spring rod 38 extends outwardly from base 34, preferably at an oblique angle, to attached engagement with ball mark repairer 12. As best observed at FIG. 3, spring rod 38 terminates into upwardly extending end 40. The ball mark repairer 12 includes an upper end portion 42 having a hole 44. Hole 44 is suited to receive the upwardly extending end 40 of spring rod 38 to dispose the upper end portion 42 of ball mark repairer 12 between the upwardly extending end 40 and a first retention element 46 of the underside surface 28 of tray body 14. First retention element 46 is located above a portion of the length of said spring rod to limit inward movement of the upper end portion 42 of ball mark repairer 12 along spring rod 38 and achieve a locking of the ball mark repairer 12 in relation to tray body 14. In this regard, ball mark repairer 12 is hingedly connected to tray body 14 such that the user can selectively achieve a closed position as illustrated at FIG. 2 wherein the ball mark repairer 12 is substantially parallel to tray body 14 such that it can be used to repair golf ball divot marks, or an open position shown at FIG. 3 wherein the ball mark repairer 12 is substantially perpendicular to tray body 14 such that the plurality of prongs 22 and 24 can be inserted into a ground surface to thereby allow easy access to upper surface 26 of tray body 14 to support a cigar, cigarette, or other object at a stabilized and defined locus. Spring rod 38 provides a biasing effect to effectively lock the upper end portion 42 of ball mark repairer 12 in a selective and releasable manner between the first retention element 46 and the upwardly extending end 40 of spring rod 38 when the cigar caddie divot repair tool is disposed either in the previously described closed or open positions. In addition to the biasing effect, the upwardly extending end 40 of spring rod 38 limits outward movement of the upper end portion 42 of ball mark repairer 12 from spring rod 38. Optionally, a second retention element 48 may be provided on the underside surface 28 of tray body 14 at a point outwardly adjacent the upwardly extending end 40 of spring rod 38 to strengthen the ability of upwardly extending end 40 to limit outward movement of the upper end portion 42 of ball mark repairer 12 from spring rod 38. The retention elements 46 and 48 may each be comprised of either a singular detent or a plurality of aligned detents formed from a stamping of upper surface 26 of tray body 14. In this regard, the FIG. 1 top view of the cigar caddie divot repair tool illustrates the first retention element 46 as a singular stamped detent and the second retention element 48 as a cooperative plurality of aligned detents.

Referring now to FIG. 5, the width between the left side portion 30 and a right side portion 32 of tray body 14 is preferably sufficient not only to hold a cigar or cigarette but also to accommodate the thumb of a golfer to thereby form a grip concavity for the golfer's thumb when the cigar caddie divot repair tool is in its previously described closed position and the ball mark repairer is being used to repair turf. Also the upper end portion 42 of ball mark repairer 12 preferably has a concave end surface 50 at ball mark repairer upper edge 52 suited to cooperatively accommodate, support, and stabilize the underside surface 28 of tray body 14.

FIG. 6 is a top view of another embodiment of the cigar caddie divot repair tool of the present invention. In this embodiment, cigar caddie divot repair tool 60 is identical to the cigar divot repair tool 10 previously described except for the presence of a downwardly extending prong cooperative retention element 62 at a forward section 64 of the underside surface 28 of the tray body 14 and the width between the plurality of prongs 66 and 68 of ball mark repairer 70 extending more inwardly of base section 72. When cigar caddie divot repair tool 60 is in a closed position as illustrated at FIGS. 6 and 7, the prong cooperative retention element 62 is dimensioned to cooperatively seat between the plurality of prongs 66 and 68 in a releasable interference fit manner preferably at a point approximately adjacent where the plurality of prongs 66 and 68 merge into base section 72 of ball mark repairer 70. In this way, the prong cooperative retention element 62 can selectively and releaseably lock cigar caddie divot repair tool 60 in the closed position either independently of or in combination with the first retention element 46, the upwardly extending end 40 of spring rod 38, and second retention element 48. This selective and releasable locking is particularly advantageous in preventing lateral movement of tray body 14 relative ball mark repairer 70 when caddie divot repair tool 60 is in the closed position.

FIG. 8 is a side view of yet another embodiment of the cigar caddie divot repair tool of the present invention. In this embodiment, cigar caddie divot repair tool 80 is identical to the cigar divot repair tool 10 previously described except for the presence of a downwardly extending male retention element 82 at the underside surface 28 of the tray body 14 which, when cigar caddie divot repair tool 80 is in a closed position, is dimensioned to cooperatively seat within a female area 84 of base section 86 of ball mark repairer 88 in a releasable interference fit manner. Female area 84 may comprise a cooperative stamped or depressed receiving area in the surface of base section 86, as illustrated at FIGS. 8 and 9, or a cooperatively dimensioned through bore. In this way, the male retention element 82 in cooperation with female area 84 of base section 86 can also selectively and releaseably lock cigar caddie divot repair tool 80 in the closed position either independently of or in combination with the first retention element 46, the upwardly extending end 40 of spring rod 38, and second retention element 48. Again, this selective and releasable locking is particularly advantageous in preventing lateral movement of tray body 14 relative ball mark repairer 88 when caddie divot repair tool 80 is in the closed position.

The cigar caddie divot repair tools 10, 60, and 80 are preferably assembled from three pieces of metal or suitable plastic mold construction, namely the tray body 14 integral with base 34 and at least the first retention element 46, spring rod 38, and ball mark repairer 12, 70, or 88.

From the foregoing description, it will be apparent that the cigar caddie divot repair tool of the present invention in its varying embodiments has a number of advantages, some of which have been described above and other of which are inherent in the invention. Also, it will be understood that modifications can be made to the cigar caddie divot repair tool described above without departing from the teachings of the present invention. For example, although one type of "ball mark" repair tool has been described and depicted, it is clear that many variations on the two-prong type ball mark repairer are possible, such as ball mark repairers with three prongs or those shaped with additional elements or structure for opening crown-top bottles, for screwing in studs, for the cleaning of golf clubs or for retaining a golf ball marker, to name but a few. The components of the present invention could also be varied in their material composition but would normally be either metal or plastic, or a combination of both. Accordingly, the scope of the invention is only to be limited as necessitated by the accompanying claims and not to the forms hereinbefore described which are merely preferred or exemplary embodiments.

We claim:

1. A cigar caddie divot repair tool comprising a ball mark repairer for repairing dents and divots in a golf green and a tray body having a substantially uniform upper receiving surface along a longitudinal central axis of said tray body for the support of an object to be placed thereon, said ball mark repairer being hingedly interconnected to said tray body to selectively achieve a closed inoperative position of said tray body wherein the ball mark repairer is substantially parallel to said uniform upper receiving surface of said tray body or an open operative position of said tray body wherein said ball mark repairer is substantially perpendicular to said uniform upper receiving surface of said tray body.

2. The cigar caddie divot repair tool of claim 1 wherein said tray body is elongated and at least partially upwardly curved at each of its side contours to provide a border to said uniform upper receiving surface.

3. The cigar caddie divot repair tool of claim 2 wherein said tray body is elongated and at least partially upwardly curved at each of its side contours to thereby form a grip concavity when the cigar caddie divot repair tool is in its closed inoperative position wherein the ball mark repairer is substantially parallel to said uniform upper receiving surface of said tray body, said grip concavity being suited to receive a user's thumb when the ball mark repairer is being used to repair turf.

4. The cigar caddie divot repair tool of claim 1 wherein said tray body further includes an underside surface and a base at said underside surface cooperative with a spring rod, said base retaining only a portion of said spring rod with a remaining exposed portion of said spring rod being attached to said ball mark repairer.

5. The cigar caddie divot repair tool of claim 4 wherein said spring rod extends outwardly from said base at an oblique angle.

6. The cigar caddie divot repair tool of claim 4 wherein said tray body further includes a retention element on said underside surface of said tray body aligned across from said base and above said remaining exposed portion of said spring rod.

7. The cigar caddie divot repair tool of claim 6 wherein said spring rod terminates in an upwardly extending end and said ball mark repairer includes an upper end portion having a hole, said hole being suited to receive said upwardly extending end of said spring rod to dispose and limit movement of said upper end portion of said ball mark repairer between said upwardly extending end and said retention element.

8. The cigar caddie divot repair tool of claim 7 wherein said limited movement of said upper end portion of said ball mark repairer between said upwardly extending end and said retention element selectively and releaseably locks said ball mark repairer in an open or closed position relative said tray body.

9. The cigar caddie divot repair tool of claim 1 wherein said ball mark repairer includes a base section and a plurality of prongs extending downwardly from said base section, the outer most ends of said prongs being sufficiently spaced outwardly from said base section for cooperating therewith to form a tool that is useful to repair dents and divots in a golf green.

10. The cigar caddie divot repair tool of claim 9 wherein said base section and said prongs are substantially planar in side profile.

11. The cigar caddie divot repair tool of claim 9 wherein said prongs are symmetrical in shape.

12. The cigar caddie divot repair tool of claim 9 wherein said prongs terminate from said base section in rounded tips.

13. The cigar caddie divot repair tool of claim 9 wherein said ball mark repairer is hingedly interconnected to said tray body to selectively achieve a closed position wherein the ball mark repairer is substantially parallel to said tray body or an open position wherein said ball mark repairer is substantially perpendicular to said tray body, said tray body including a prong cooperative retention element at its underside surface dimensioned to cooperatively seat between said plurality of prongs of said ball mark repairer when said cigar caddie divot repair tool is in a closed position.

14. The cigar caddie divot repair tool of claim 9 wherein said ball mark repairer is hingedly interconnected to said tray body to selectively achieve a closed position wherein the ball mark repairer is substantially parallel to said tray body or an open position wherein said ball mark repairer is substantially perpendicular to said tray body, said tray body including a male retention element at its underside surface dimensioned to cooperatively seat within a female area of said base section of said ball mark repairer when said cigar caddie divot repair tool is in a closed position.

15. The cigar caddie divot repair tool of claim 9 wherein said base section of said ball mark repairer has a concave surface at its upper end to cooperate with an underside surface of said tray body.

* * * * *